US010884362B2

(12) United States Patent
Hisada

(10) Patent No.: US 10,884,362 B2
(45) Date of Patent: Jan. 5, 2021

(54) FIXING DEVICE, IMAGE FORMING APPARATUS, FIXING METHOD, AND NON-TRANSITORY COMPUTER-READABLE STORAGE MEDIUM

(71) Applicant: Masahiko Hisada, Kanagawa (JP)

(72) Inventor: Masahiko Hisada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/705,456

(22) Filed: Dec. 6, 2019

(65) Prior Publication Data

US 2020/0233343 A1 Jul. 23, 2020

(30) Foreign Application Priority Data

Jan. 18, 2019 (JP) ..... 2019-006987

(51) Int. Cl.
*G03G 15/20* (2006.01)
*G03G 15/00* (2006.01)

(52) U.S. Cl.
CPC ..... *G03G 15/205* (2013.01); *G03G 15/2039* (2013.01); *G03G 15/55* (2013.01)

(58) Field of Classification Search
CPC ... G03G 15/2039; G03G 15/55; G03G 15/205
See application file for complete search history.

(56) References Cited

U.S. PATENT DOCUMENTS 5,878,301 A * 3/1999 Katakura ..... G03G 15/2064 399/331
8,737,861 B2 * 5/2014 Hase ..... G03G 15/55 399/70
8,855,506 B2 * 10/2014 Hase ..... G03G 15/205 399/18
9,529,308 B2 * 12/2016 Ikebuchi ..... G03G 15/2039
2013/0209128 A1 * 8/2013 Saito ..... G03G 15/2042 399/69
2014/0253626 A1 9/2014 Masaoka et al.
2014/0347685 A1 11/2014 Hisada
2015/0062223 A1 3/2015 Takeuchi et al.
2015/0097894 A1 4/2015 Masaoka et al.
2016/0325550 A1 11/2016 Masaoka et al.

FOREIGN PATENT DOCUMENTS

JP 2005-338634 12/2005
JP 2008-040401 2/2008

* cited by examiner

*Primary Examiner* — Arlene Heredia
(74) *Attorney, Agent, or Firm* — Oblon, McClelland, Maier & Neustadt, L.L.P.

(57) ABSTRACT

A fixing device includes a heating rotator, a pressure rotator, a temperature detector, and circuitry. The pressure rotator presses against the heating rotator. The temperature detector detects a temperature of the heating rotator. The circuitry energizes and deenergizes a heater of the heating rotator to control a fixing temperature of the heating rotator to be a reference value. The circuitry controls a direction of rotation of each of the heating rotator and the pressure rotator to drive each of the heating rotator and the pressure rotator in one of the fixing direction of rotation and a reverse direction of rotation. The circuitry changes the direction of rotation of each of the heating rotator and the pressure rotator to the reverse direction of rotation in a case in which the fixing temperature is less than the reference value upon an elapse of a period of time from a start of heating.

10 Claims, 8 Drawing Sheets

FIXING DEVICE, IMAGE FORMING APPARATUS, FIXING METHOD, AND NON-TRANSITORY COMPUTER-READABLE STORAGE MEDIUM

CROSS-REFERENCE TO RELATED APPLICATION

This patent application is based on and claims priority pursuant to 35 U.S.C. § 119(a) to Japanese Patent Application No. 2019-006987, filed on Jan. 18, 2019, in the Japan Patent Office, the entire disclosure of which is hereby incorporated by reference herein.

BACKGROUND

Technical Field

Embodiments of the present disclosure generally relate to a fixing device, an image forming apparatus, a fixing method, and a non-transitory computer-readable storage medium, and more particularly, to a fixing device for fixing a toner image onto a recording medium, an image forming apparatus for forming an image on a recording medium with the fixing device, a method for fixing a toner image onto a recording medium, and a non-transitory computer-readable storage medium storing computer-readable program code that causes a computer to execute the fixing method.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, an image is formed on the recording medium.

Such a fixing device typically includes a fixing rotator, such as a roller, a belt, and a film, and a pressure rotator, such as a roller and a belt, pressed against the fixing rotator. The fixing rotator and the pressure rotator apply heat and pressure to the recording medium, melting and fixing the toner image onto the recording medium while the recording medium is conveyed between the fixing rotator and the pressure rotator. The fixing device may employ a drum system using a roller as a fixing rotator or a belt-roll system using a belt as a fixing rotator. The fixing device may also include a controller and a temperature detector that is disposed near the surface of the roller or the belt to detect a surface temperature of the roller or the belt. Based on the surface temperature detected, the controller obtains a heater temperature-time characteristic during a warm-up operation of the fixing device or upon transition from an energy saving mode to a normal use state. According to the inclination of the heater temperature-time characteristic, the controller corrects calculation of a heating duty. Thus, the fixing device may be controlled so as to optimize an amount of heat generation of a fixing heater.

SUMMARY

In one embodiment of the present disclosure, a novel fixing device includes a heating rotator, a pressure rotator, a temperature detector, and circuitry. The heating rotator includes a heater. The pressure rotator is configured to press against the heating rotator to form a fixing nip through which a recording medium bearing a toner image is conveyed by the heating rotator and the pressure rotator each moving in a fixing direction of rotation. The temperature detector is configured to detect a temperature of the heating rotator. The circuitry is configured to energize and deenergize the heater of the heating rotator to control a fixing temperature of the heating rotator to be a reference value. The circuitry is configured to control a direction of rotation of each of the heating rotator and the pressure rotator to drive each of the heating rotator and the pressure rotator in one of the fixing direction of rotation and a reverse direction of rotation opposite the fixing direction of rotation. The circuitry is configured to change the direction of rotation of each of the heating rotator and the pressure rotator to the reverse direction of rotation in a case in which the fixing temperature is less than the reference value upon an elapse of a given period of time from a start of heating.

Also described is a novel image forming apparatus incorporating the fixing device.

Also described are novel fixing method and non-transitory, computer-readable storage medium storing computer-readable program code that causes a computer to perform the fixing method.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
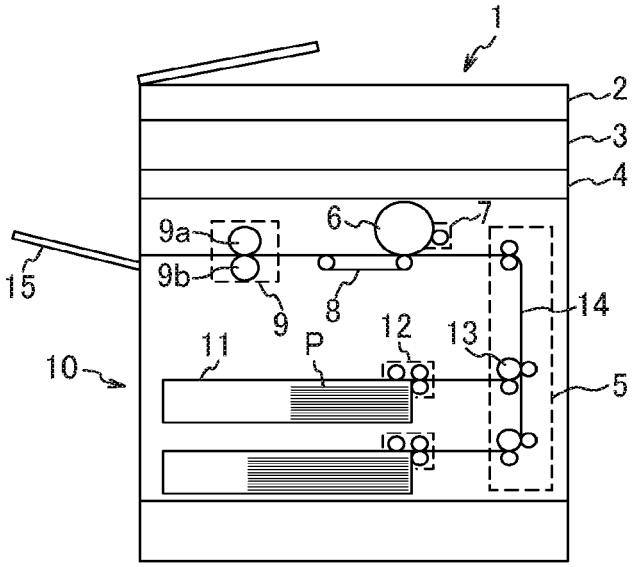
FIG. 1 is a schematic sectional view of an image forming apparatus according to an embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

Referring to the drawings, wherein like reference numerals designate identical or corresponding parts throughout the several views, embodiments of the present disclosure are described below.

According to an embodiment of the present disclosure, a fixing device is configured as below to provide information indicating that extraneous matter accumulates between a temperature detector and a roller and remove the extraneous matter therefrom, thereby allowing a continuation of an image forming operation.

Specifically, the fixing device includes a heating rotator and a pressure rotator that presses against the heating rotator to form a fixing nip between the heating rotator and pressure rotator. The heating rotator includes a heater. While a recording medium bearing a toner image is conveyed through the fixing nip by the heating rotator and the pressure rotator each rotating or moving in a fixing direction of rotation, the fixing device fixes the toner image onto the recording medium. The fixing device further includes a temperature detector and a controller. The temperature detector detects a temperature of the heating rotator. The controller energizes and deenergizes the heater of the heating rotator to control a fixing temperature of the heating rotator to be a reference value. The controller also controls a direction of rotation of each of the heating rotator and the pressure rotator to drive each of the heating rotator and the pressure rotator in one of a fixing direction of rotation and a reverse direction of rotation opposite the fixing direction of rotation. In a case in which the fixing temperature is less than the reference value upon an elapse of a given period of time from a start of heating, the controller changes the direction of rotation of each of the heating rotator and the pressure rotator to the reverse direction of rotation.

Even in a case in which extraneous matter accumulates on the temperature detector, the fixing device with such a configuration provides information indicating the accumulation of the extraneous matter and removes the extraneous matter from the temperature detector, thereby allowing a continuation of an image forming operation.

Initially with reference to FIG. 1, a description is given of an overall configuration of an image forming apparatus 1 according to a first embodiment of the present disclosure.

FIG. 1 is a schematic sectional view of the image forming apparatus 1.

As illustrated in FIG. 1, the image forming apparatus 1 includes an automatic document feeder (ADF) 2, an image reader 3, a writer 4, a conveyance device 5, a photoconductor 6, a developing device 7, a transfer belt 8, a fixing device 9, a sheet feeder 10, and an output tray 15. In a copy mode, the ADF 2 feeds a plurality of documents to the image reader 3 one by one. The image reader 3 reads image data from each of the plurality of documents. The writer 4 converts the image data thus read into optical data via an image processor. The photoconductor 6 is a photoconductive drum. After a charger uniformly charges the photoconductor 6, the writer 4 exposes the photoconductor 6 according to the optical data, thereby forming an electrostatic latent image on the photoconductor 6.

The developing device 7 develops the electrostatic latent image on the photoconductor 6 into a visible toner image. As the photoconductor 6 rotates, the toner image is transferred from the photoconductor 6 onto a recording medium P conveyed on the transfer belt 8. The fixing device 9 fixes the toner image onto the recording medium P. Then, the recording medium P bearing the fixed toner image is output onto the output tray 15.

The sheet feeder 10 includes, e.g., an input tray 11, a sheet feeding roller 12, and a separation pad. A plurality of recording media P is stored on the input tray 11. In the sheet feeder 10, the sheet feeding roller 12 separates a recording medium P from the rest of the plurality of recording media P on the input tray 11, together with the separation pad, thereby conveying the plurality of recording media P to the conveyance device 5 one by one.

The conveyance device 5 includes a registration roller pair 13 and a conveyance passage 14 defined by internal components of the image forming apparatus 1. The conveyance device 5 conveys the recording medium P sent out from the sheet feeder 10 to the registration roller pair 13. A registration sensor detects the recording medium P conveyed to the registration roller pair 13. As described above, the toner image is transferred from the photoconductor 6 onto the recording medium P conveyed by the conveyance device 5. The recording medium P bearing the toner image is conveyed to the fixing device 9.

In the present example of FIG. 1, the image forming apparatus 1 includes the fixing device 9 that employs a drum system. Specifically, the fixing device 9 includes a fixing roller 9*a*, serving as a heating or fixing rotator, and a pressure roller 9*b* serving as a pressure rotator. The pressure roller 9*b* is configured to press against the fixing roller 9*a* at a constant pressure to form a fixing nip between the fixing roller 9*a* and the pressure roller 9*b*. The toner image is fixed onto the recording medium P under heat and pressure while the recording medium P is sandwiched at the fixing nip and conveyed by the fixing roller 9*a* and the pressure roller 9*b* both rotating. The fixing device 9 sends out the recording medium P bearing the fixed toner image to the output tray 15.

Figure 2A:
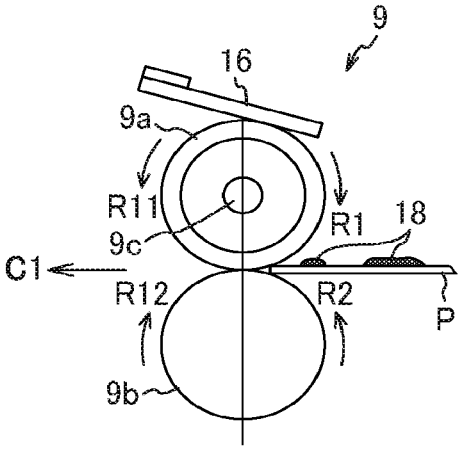
FIG. 2A is a partial view of a fixing device employing a drum system incorporated in the image forming apparatus of FIG. 1, illustrating no extraneous matter accumulates on a thermistor.
Figure 2B:
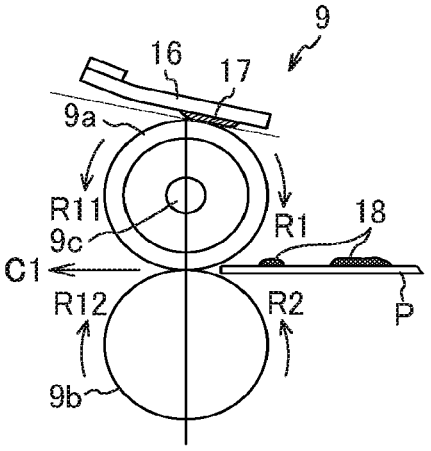
FIG. 2B is another partial view of the fixing device employing the drum system incorporated in the image forming apparatus of FIG. 1, illustrating extraneous matter accumulates on the thermistor.

Referring now to FIGS. 2A and 2B, a description is given of a configuration of the fixing device 9 that employs the drum system using the fixing roller 9*a* as a fixing rotator.

FIG. 2A is a partial view of the fixing device 9 incorporated in the image forming apparatus 1 described above, illustrating no extraneous matter accumulates on a thermistor 16. FIG. 2B is another partial view of the fixing device 9 incorporated in the image forming apparatus 1 described above, illustrating extraneous matter accumulates on the thermistor 16.

As illustrated in FIGS. 2A and 2B, the fixing device 9 includes the fixing roller 9*a*, the pressure roller 9*b*, a fixing heater 9*c*, and the thermistor 16. The thermistor 16, serving as a temperature detector, is a contact thermistor in the present embodiment.

In the fixing device 9, the pressure roller 9*b* and the fixing roller 9*a* including the fixing heater 9*c* are rotatably disposed. The fixing heater 9*c* is disposed inside the fixing roller 9*a* to heat the fixing roller 9*a* to a given standby temperature and a fixing temperature. Thus, the temperature of the fixing roller 9*a* is controlled.

In the fixing device 9, the thermistor 16 is disposed near an outer circumferential surface of the fixing roller 9*a* to detect a surface temperature of the fixing roller 9*a*. The thermistor 16 outputs the surface temperature of the fixing roller 9*a* thus detected to a controller 20 illustrated in FIG. 7. Note that the thermistor 16 is herein a contact thermistor that contacts the outer circumferential surface of the fixing roller 9*a* to detect the surface temperature of the fixing roller 9*a*. Alternatively, however, the thermistor 16 may be a non-contact thermistor.

The fixing heater 9*c* is, e.g., a halogen heater that generates heat according to an energization amount to heat the fixing roller 9*a*.

Referring now to FIG. 2A, as the fixing roller 9*a* rotates in a direction of rotation R1, the pressure roller 9*b* in contact with the fixing roller 9*a* rotates in a direction of rotation R2. Accordingly, the recording medium P bearing unfixed toner 18 moves in a direction of conveyance C1 and sandwiched at the fixing nip between the fixing roller 9*a* and the pressure roller 9*b*. At the fixing nip, the unfixed toner 18 is melt by heat from the fixing roller 9*a* and fixed onto the recording medium P. Thus, a fixing operation is completed in a normal state.

Referring now to FIG. 2B, as the fixing roller 9*a* rotates in the direction of rotation R1, the pressure roller 9*b* in contact with the fixing roller 9*a* rotates in the direction of rotation R2.

Accordingly, the recording medium P bearing the unfixed toner 18 moves in the direction of conveyance C1 and sandwiched at the fixing nip between the fixing roller 9*a* and the pressure roller 9*b*. At the fixing nip, the unfixed toner 18 is melt by heat from the fixing roller 9*a* and fixed onto the recording medium P.

At this time, however, a small amount of the unfixed toner 18 fails to be fixed onto the recording medium P and therefore remains on the fixing roller 9*a* as residual toner 17. The residual toner 17 gradually accumulates on the thermistor 16.

As a consequence, an error is generated between an actual temperature of the fixing roller 9*a* and a resistance value detected by the thermistor 16 with respect to a basic temperature-resistance value characteristic that the thermistor 16 originally has. Although the temperature of the fixing roller 9*a* reaches a reference value, such an error causes the controller 20 to erroneously determine that the temperature of the fixing roller 9*a* is less than the reference value. The controller 20 then causes a service call (SC) and stops the image forming apparatus 1. A detailed description thereof is deferred with reference to FIGS. 6A and 6B.

Figure 3A:
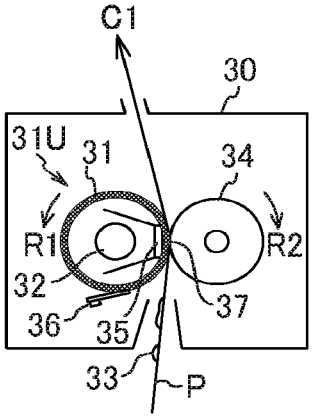
FIG. 3A is a partial view of a fixing device employing a belt, direct-heating (DH) system incorporable in the image forming apparatus of FIG. 1.
Figure 3B:
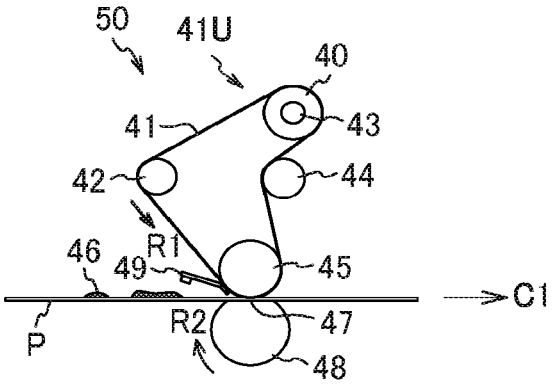
FIG. 3B is a partial view of a fixing device employing a belt-roll system incorporable in the image forming apparatus of FIG. 1.

Referring now to FIGS. 3A and 3B, a description is given of configurations of fixing devices each employing a belt system using a belt as a fixing rotator.

FIG. 3A is a partial view of a fixing device 30 employing a belt, direct-heating (DH) system incorporable in the image forming apparatus 1 described above. FIG. 3B is a partial view of a fixing device 50 employing a belt-roll system incorporable in the image forming apparatus 1 described above.

Initially with reference to FIG. 3A, the fixing device 30 includes a fixing belt 31 serving as a heating or fixing rotator, a pressure roller 34, a thermistor 36, and various components disposed inside a loop formed by the fixing belt 31, such as a fixing heater 32 and a fixing pad 35. The fixing belt 31 and the components disposed inside the loop formed by the fixing belt 31 constitute a belt unit 31U, which is detachably coupled to the pressure roller 34.

In the belt DH system, the fixing heater 32 directly heats the fixing belt 31. Specifically, the fixing heater 32 directly heats the fixing belt 31 having a reduced heat capacity, thereby efficiently conducting heat.

The fixing belt 31 illustrated in FIG. 3A is constructed of three layers: a base layer, an elastic layer, and a toner release layer. The base layer is a metal thin-film layer having a thickness reduced to the limit to reduce the heat capacity. The elastic layer is a silicone rubber layer resting on the base layer. The toner release layer is a Teflon (registered trademark) layer resting on the elastic layer.

As the fixing belt 31 rotates in the direction of rotation R1, the pressure roller 34 in contact with the fixing belt 31 rotates in the direction of rotation R2.

Accordingly, a recording medium P bearing unfixed toner 33 moves in the direction of conveyance C1 and sandwiched at a fixing nip 37 between the pressure roller 34 and the fixing belt 31 that is pressed by the fixing pad 35 against the pressure roller 34. At the fixing nip 37, the unfixed toner 33 is melt by heat from the fixing belt 31 and fixed onto the recording medium P. Thus, a fixing operation is completed in a normal state.

Referring now to FIG. 3B, the fixing device 50 includes a fixing belt 41 serving as a heating or fixing rotator, an external heating roller 44, a pressure roller 48, a thermistor 49, and various components disposed inside a loop formed by the fixing belt 41, such as an internal heating roller 40, a tension roller 42, a fixing heater 43, and a fixing roller 45. The fixing belt 41 and the components disposed inside the loop formed by the fixing belt 41 constitute a belt unit 41U, which is detachably coupled to the pressure roller 48.

In the belt-roll system, the fixing belt 41 is directly heated by the internal heating roller 40 and the external heating roller 44. That is, the internal heating roller 40 and the external heating roller 44 directly heats the fixing belt 41 for efficient heat conduction.

As the fixing belt 41 rotates in the direction of rotation R1, the pressure roller 48 in contact with the fixing roller 45 via the fixing belt 41 rotates in the direction of rotation R2.

Accordingly, a recording medium P bearing unfixed toner 46 moves in the direction of conveyance C1 and sandwiched at a fixing nip 47 between the pressure roller 48 and the fixing belt 41 in contact with the fixing roller 45. At the fixing nip 47, the unfixed toner 46 is melt by heat from the fixing belt 41 and fixed onto the recording medium P.

However, in the belt DH system and the belt-roll system described above, accumulation of toner or extraneous matter on the thermistor 36 or 49 arises an unfavorable situation as in the belt system described above with reference to FIGS. 2A and 2B. That is, the controller 20 may erroneously determines that the temperature of the fixing belt 31 or 41 is less than a reference value when a given period of time elapses after startup. In such a case, the controller 20 causes an SC and stops the image forming apparatus 1.

Figure 4:
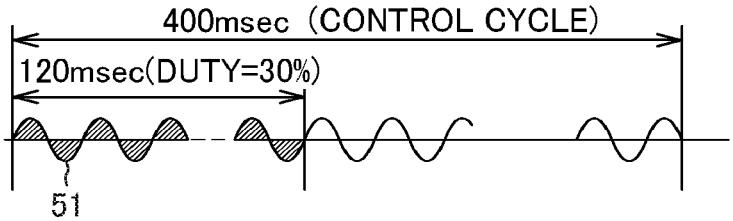
FIG. 4 is a graph for describing how to control a fixing heater according to an embodiment of the present disclosure.

Referring now to FIGS. 2A, 2B, and 4, a description is given of how to control a fixing heater.

FIG. 4 is a graph for describing how to control a fixing heater (e.g., fixing heater 9*c*) according to the present embodiment.

In order to control the fixing heater 9*c*, an actual temperature detected by the thermistor 16, serving as a fixing temperature sensor or a temperature detector, is compared with a reference temperature specified in advance. A ratio, expressed as a percentage, for energizing the fixing heater 9*c* per unit time is set based on the comparison result. Note that the ratio for energizing the fixing heater 9*c* is hereinafter referred to as a heating duty. The unit time is referred to as a control cycle of 400 milliseconds (msec) in FIG. 4. According to the heating duty thus set, the fixing heater 9*c* is energized.

For example, in FIG. 4, the heating duty is set to 30% with respect to the control cycle of 400 milliseconds (msec). That is, a heating cycle is 120 milliseconds (msec). The fixing heater 9*c* is energized or turned on in the heating cycle of 120 milliseconds (msec) as indicated by shaded portions defined by a waveform 51 in FIG. 4; whereas the fixing heater 9*c* is deenergized or turned off for the remaining 280 milliseconds (msec).

In other words, the heating duty is settable between 0% and 100%. When the heating duty is 0%, the fixing heater is deenergized. By contrast, when the heating duty is 100%, the fixing heater is fully energized. The heating duty is increased to raise a heater temperature; whereas the heating duty is decreased to lower the heater temperature. Thus, the heating duty is controlled.

Thus, the fixing heater 9*c* is energized and deenergized with the heating duty set for each control cycle. Accordingly, the fixing roller 9*a* is controlled to maintain a reference temperature.

Figure 5A:
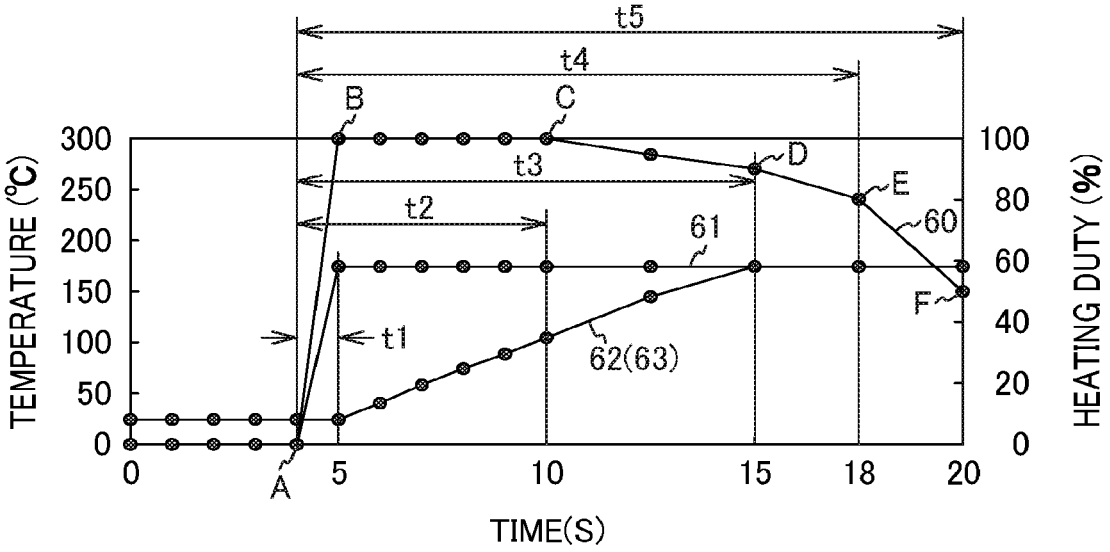
FIG. 5A is a composite graph illustrating transition of heater temperature and heating duty in a case in which no extraneous matter accumulates on a thermistor.
Figure 5B:
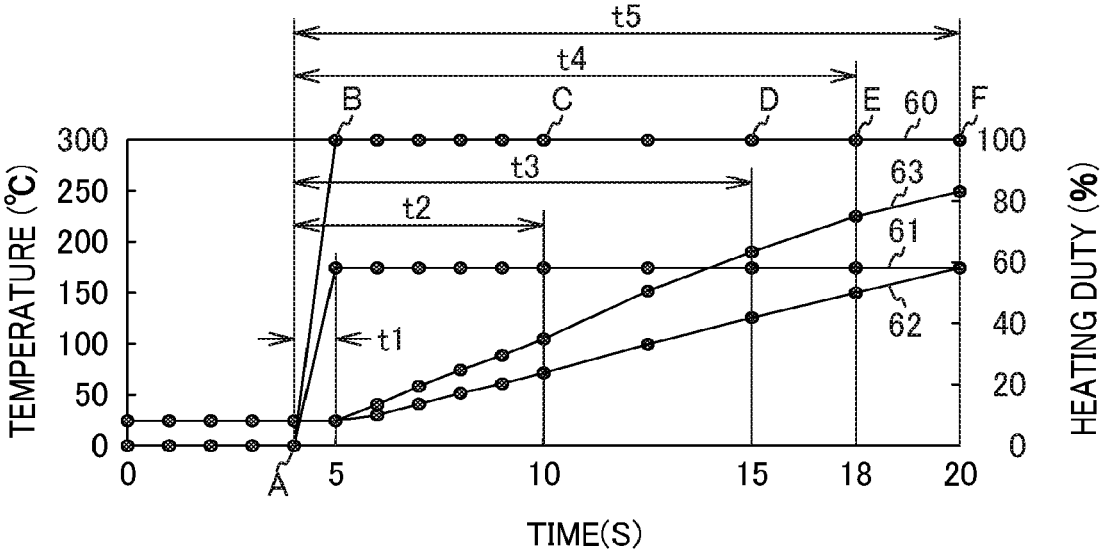
FIG. 5B is another composite graph illustrating transition of the heater temperature and the heating duty in a case in which extraneous matter accumulates on the thermistor.

Referring now to FIGS. 5A and 5B, a description is given of transition of a heater temperature (e.g., temperature of the fixing heater 9*c*) and the heating duty.

FIG. 5A is a composite graph illustrating transition of the heater temperature and the heating duty in a case in which no extraneous matter accumulates on a thermistor (e.g., thermistor 16). FIG. 5B is another composite graph illustrating transition of the heater temperature and the heating duty in a case in which extraneous matter accumulates on the thermistor (e.g., thermistor 16).

In FIGS. 5A and 5B, the horizontal axis indicates the time (sec). The left-vertical axis indicates the temperature (° C.). The right-vertical axis indicates the heating duty (%). FIGS. 5A and 5B illustrate a heating duty graph 60, a reference temperature graph 61, a detected temperature graph 62, and a true temperature graph 63. FIG. 5A illustrates the true temperature graph 63 as ideally the same as the detected temperature graph 62.

Referring now to FIG. 5A, a description is given of the transition of the heater temperature and the heating duty in response to a main power of the image forming apparatus 1 being turned on for the first time in the morning when the fixing device (e.g., fixing device 9) is in a cold state, for example.

FIG. 5A illustrates a case in a normal state in which no extraneous matter accumulates on the thermistor 16. The fixing device 9 is activated when the main power is turned on at a point A. When a period of time "t1" (i.e., 5 seconds from the point A) elapses, the heating duty is set to 100% at a point B to energize the fixing heater 9*c*. Since the difference between the detected temperature graph 62 and the reference temperature graph 61 is relatively large during a period of time "t2" (i.e., 10 seconds from the point A), the fixing heater 9*c* is energized, with a continued heating duty of 100%, between the point B and a point C. Since the detected temperature graph 62 rises and approaches the reference temperature graph 61 to some extent during a period of time "t3" (i.e., 15 seconds from the point A), the heating duty is gradually decreased to prevent the heater temperature from exceeding a reference temperature between the point C and a point D. Thus, the heating duty is controlled to bring the detected heater temperature close to a target temperature between the point D and a point F via a point E.

In FIG. 5A, the heating duty is controlled to: 100% during the period of time "t2" (i.e., 10 seconds from the point A), 90% during the period of time "t3" (i.e., 15 seconds from the point A), 80% during a period of time "t4" (i.e., 18 seconds from the point A), and 50% during a period of time "t5" (i.e., 20 seconds from the point A).

Referring now to FIG. 5B, a description is given of the transition of the heater temperature and the heating duty in response to the main power of the image forming apparatus 1 being turned on for the first time in the morning when the fixing device (e.g., fixing device 9) is in a cold state, for example. Note that identical reference numerals are assigned to components identical or equivalent to the components illustrated in FIG. 5A.

FIG. 5B illustrates a case in an abnormal state in which extraneous matter accumulates on the thermistor 16. The fixing device 9 is activated when the main power is turned on at the point A. Since the detected temperature graph 62 is lower than the true temperature graph 63 during the period of time "t2" (i.e., 10 seconds from the point A), the fixing heater 9*c* is continuously energized with the heating duty of 100% between the point B and the point C.

When the detected temperature graph 62 rises and approaches the reference temperature graph 61 to some extent, the heating duty is gradually decreased to prevent the heater temperature from exceeding the reference temperature. However, in FIG. 5B, the true temperature graph 63 reaches the reference temperature graph 61 between the point C and the point D; whereas the detected temperature graph 62 is yet to reach the reference temperature graph 61. Therefore, the fixing heater 9*c* is continuously energized with the heating duty of 100% between the point C and the point F via the point D and the point E.

The detected temperature graph 62 reaches the reference temperature graph 61 at the point F. At this time, the true temperature graph 63 reaches a temperature of 250° C. That is, at the point F, the true temperature (i.e., 250° C.) is higher than the reference temperature (i.e., 175° C.) by 75° C. Keeping such a condition may damage the fixing device 9. To address such an unfavorable situation, according to the embodiments of the present disclosure, the fixing device (e.g., fixing device 9) provides information indicating accumulation of extraneous matter on the thermistor (e.g., thermistor 16) and performs an appropriate process as described later.

In FIG. 5B, the heating duty is controlled to 100% during all the periods of time "t2" (i.e., 10 seconds from the point A), "t3" (i.e., 15 seconds from the point A), "t4" (i.e., 18 seconds from the point A), and "t5" (i.e., 20 seconds from the point A).

Figure 6A:
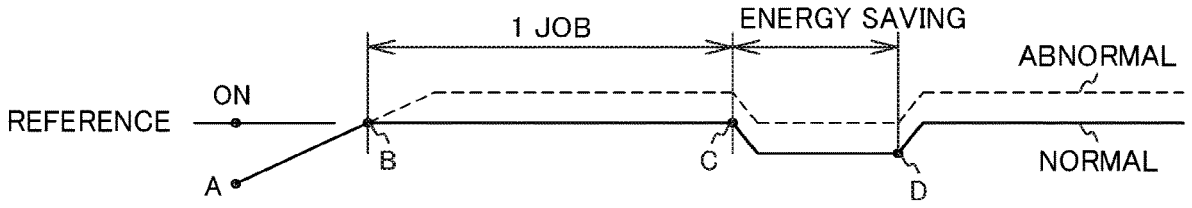
FIG. 6A is a graph illustrating comparative changes in temperature of a fixing roller.
Figure 6B:
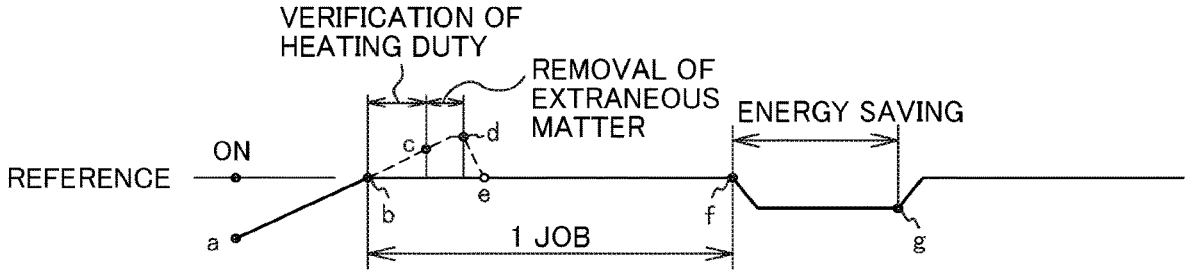
FIG. 6B is a graph illustrating changes in temperature of the fixing roller according to an embodiment of the present disclosure.

Referring now to FIGS. 6A and 6B, a description is given of changes in temperature of a fixing roller (e.g., fixing roller 9*a*).

FIG. 6A is a graph illustrating comparative changes in temperature of the fixing roller 9*a*. FIG. 6B is a graph illustrating changes in temperature of the fixing roller 9*a* according to the present embodiment of the present disclosure.

In the comparative changes in temperature of the fixing roller 9*a* illustrated in FIG. 6A, the temperature rises from a point A at which the main power is turned on. At a point B, the temperature reaches a reference temperature. In a normal state in which no extraneous matter accumulates on a thermistor (e.g., thermistor 16), the fixing roller 9*a* maintains a constant temperature until a point C at which one job is completed, as indicated by the solid line in FIG. 6A. Thereafter, in a case in which no job is instructed for a certain period of time, the mode shifts to an energy saving mode, thereby slightly decreasing the temperature between the point C and a point D.

By contrast, in a case in which extraneous matter or the like accumulates on the thermistor 16 and hampers accurate detection of the temperature of the fixing roller 9*a*, an actual temperature is maintained higher than the reference temperature or value as indicated by the broken line in FIG. 6A. Keeping such a condition may cause excessive fixing and affect the life of the fixing roller 9*a*. In addition, such a condition may waste energy.

By contrast, the changes in temperature of the fixing roller 9*a* according to the present embodiment illustrated in FIG. 6B, the temperature rises from a point "a" at which the main power is turned on. At a point "b", the temperature reaches a reference temperature. In a normal state in which no extraneous matter accumulates on a thermistor (e.g., thermistor 16), the fixing roller 9*a* maintains a constant temperature until a point "f" at which one job is completed, as indicated by the solid line in FIG. 6B. Thereafter, in a case in which no job is instructed for a certain period of time, the mode shifts to an energy saving mode, thereby slightly decreasing the temperature between the point "f" and a point "g".

By contrast, in a case in which extraneous matter or the like accumulates on the thermistor 16 and hampers accurate detection of the temperature of the fixing roller 9*a*, the heating duty is verified, as described above with reference to FIGS. 5A and 5B, between the point "b" and a point "c" as indicated by the broken line in FIG. 6B. When it is determined that extraneous matter accumulates, the fixing roller 9*a* is rotated backwards to remove the extraneous matter between the point "c" and a point "d". When the extraneous matter is removed, the temperature returns to the reference temperature or value at a point "e" as indicated by the broken line in FIG. 6B.

Figure 7:
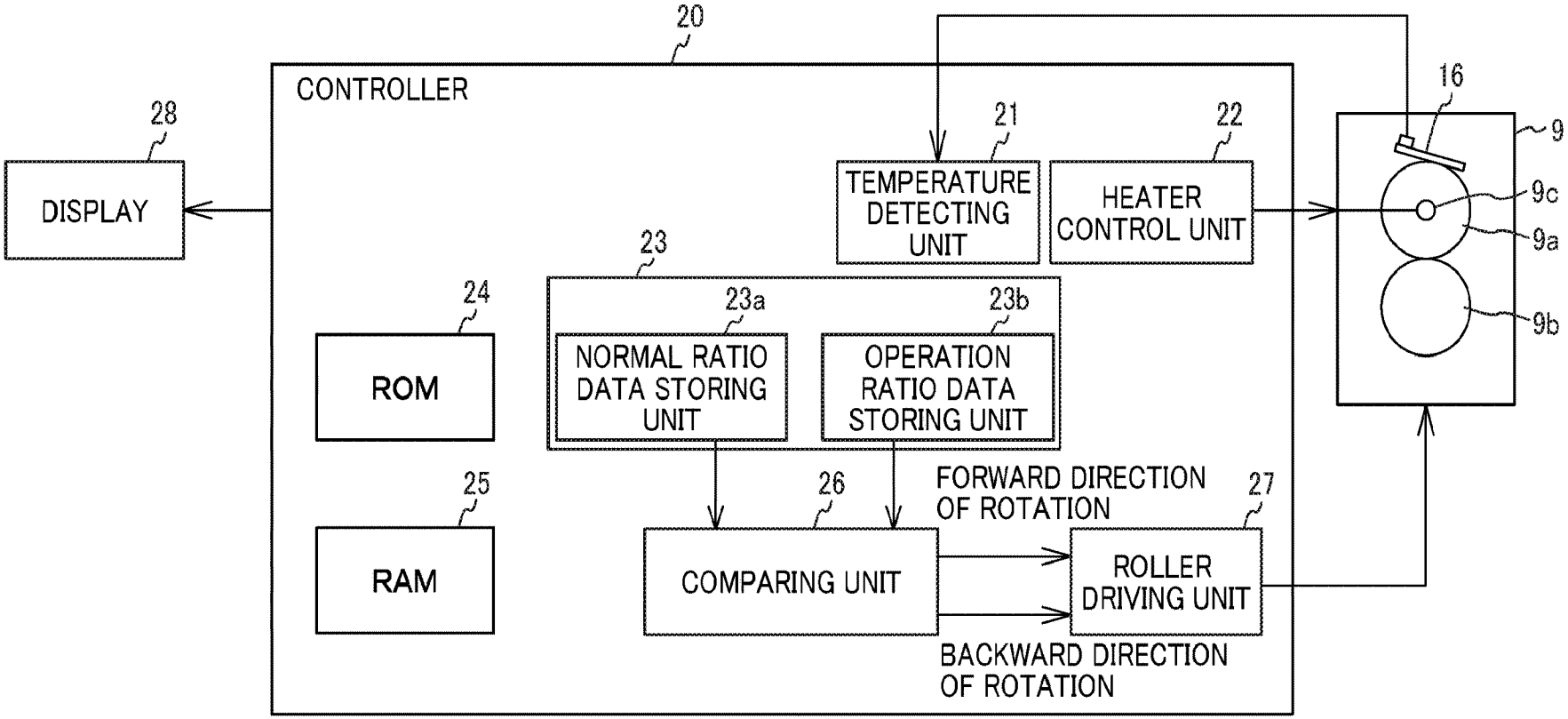
FIG. 7 is a functional block diagram of the fixing device employing the drum system illustrated in FIGS. 2A and 2B.

Referring now to FIG. 7, a description is given of functions of the fixing device 9 described above.

FIG. 7 is a functional block diagram of the fixing device 9 employing the drum system described above.

The controller 20 includes, e.g., a temperature detecting unit 21, a heater control unit 22, a normal ratio data storing unit 23*a*, an operation ratio data storing unit 23*b*, a comparing unit 26, a roller driving unit 27, a read only memory (ROM) 24, and a random access memory (RAM) 25. The normal ratio data storing unit 23*a* and the operation ratio data storing unit 23*b* are implemented by a memory 23.

The temperature detecting unit 21 converts a change in resistance value of the thermistor 16 of the fixing device 9 into a voltage. The temperature detecting unit 21 then transmits the voltage to the heater control unit 22.

The heater control unit 22 controls the heating duty of the fixing heater 9*c* based on the temperature detected by the temperature detecting unit 21.

The normal ratio data storing unit 23*a* stores normal ratio data, which is ratio or duty data (i.e., data of ratio or duty) of a duration for energizing the fixing heater 9*c* until the fixing temperature reaches a reference value or temperature in a normal state.

On the other hand, the operation ratio data storing unit 23*b* stores operation ratio data, which is ratio or duty data (i.e., data of ratio or duty) of the duration for energizing the fixing heater 9*c* until the fixing temperature reaches the reference value or temperature during operation.

When the controller 20 determines that it is time for the fixing temperature to reach the reference value, the comparing unit 26 compares average data of the duty data during operation retrieved from the operation ratio data storing unit 23*b* with average data of the duty data in the normal state retrieved from the normal ratio data storing unit 23*a*.

The roller driving unit 27 drives each of the fixing roller 9*a* and the pressure roller 9*b* in a forward direction of rotation or a backward direction of rotation based on the result of comparison by the comparing unit 26. The forward direction of rotation herein serves as a fixing direction of rotation (e.g., directions of rotation R1 and R2); whereas the backward direction of rotation herein serves as a reverse direction of rotation (e.g., directions of rotation R11 and R12) opposite the fixing direction of rotation.

The ROM 24 stores, e.g., system data and programs such as a basic program of the image forming apparatus 1 and an image forming control program of the embodiments of the present disclosure. The RAM 25 is used as a work memory for the controller 20.

The image forming apparatus 1 includes a display 28 that informs, e.g., a user of malfunction of the fixing device 9.

Referring now to FIGS. 5A, 5B, 7, and 8, a description is given of fixing control operations according to the first embodiment of the present disclosure.

Figure 8:
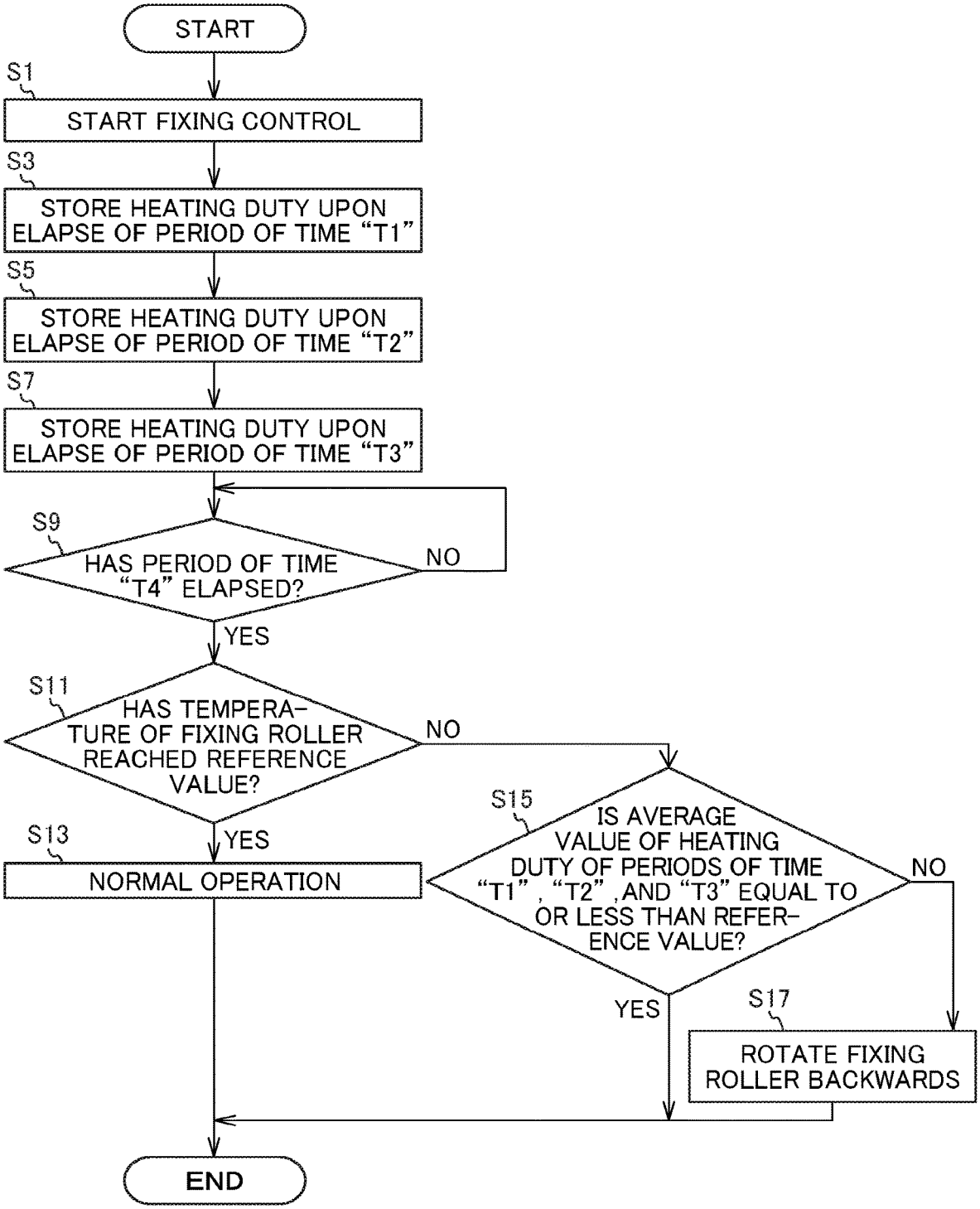
FIG. 8 is a flowchart of operations performed in the image forming apparatus according to a first embodiment of the present disclosure.

FIG. 8 is a flowchart of operations performed in the image forming apparatus 1 according to the first embodiment of the present disclosure.

In step S1, the heater control unit 22 of the controller 20 supplies power to the fixing heater 9*c* of the fixing device 9 to start fixing control (i.e., point A in FIGS. 5A and 5B).

Subsequently in step S3, the controller 20 stores, in the operation ratio data storing unit 23*b*, the heating duty upon an elapse of the period of time "t1" from a start of a timer (i.e., point B: 5 seconds from the point A in FIGS. 5A and 5B).

Subsequently in step S5, the controller 20 stores, in the operation ratio data storing unit 23*b*, the heating duty upon an elapse of the period of time "t2" (i.e., point C: 10 seconds from the point A in FIGS. 5A and 5B).

Subsequently in step S7, the controller 20 stores, in the operation ratio data storing unit 23*b*, the heating duty upon an elapse of the period of time "t3" (i.e., point D: 15 seconds from the point A in FIGS. 5A and 5B).

Subsequently in step S9, the controller 20 monitors whether the timer has counted the period of time "t4". In other words, the controller 20 determines whether the period of time "t4" has elapsed. When the period of time "t4" has not elapsed (NO in step S9), the process repeats the determination in step S9. By contrast, when the period of time "t4" has elapsed (YES in step S9), the process proceeds to step S11.

In step S11, the temperature detecting unit 21 of the controller 20 detects the temperature of the fixing roller 9*a* of the fixing device 9 with the thermistor 16 and monitors or determines whether the temperature of the heating roller 9*a* has reached a reference value. When the temperature of the heating roller 9*a* has reached the reference value (YES in step S11), the process proceeds to step S13.

In step S13, the controller 20 determines that the fixing device 9 is in a normal state. The roller driving unit 27 drives and rotates the fixing roller 9*a* forwards, as a general operation, thereby continuing the fixing operation.

By contrast, when the temperature detecting unit 21 of the controller 20 determines that the temperature of the heating roller 9*a* has not reached the reference value based on the temperature of the fixing roller 9*a* of the fixing device 9 detected with the thermistor 16 (NO in step S11), the process proceeds to step S15.

In step S15, the comparing unit 26 of the controller 20 calculates an average value of the data stored in the operation ratio data storing unit 23*b* in step S3, S5, and S7 and an average value of data stored in the normal ratio data storing unit 23*a*. The comparing unit 26 then determines whether the average value of the data stored in the operation ratio data storing unit 23*b* thus calculated is equal to or less than a reference value (i.e., average value of data stored in the normal ratio data storing unit 23*a* thus calculated). For example, FIG. 5A illustrates a normal state in which the heating duty is: 100% during the period of time "t1", 100% during the period of time "t2", and 80% during the period of time "t3". An average of the heating duty during the periods of time "t1", "t2", and "t3" is about 93%. In a case in which a reference heating duty is 95%, the average (i.e., about 93%) is less than the reference value (i.e., reference heating duty of 95%), that is, YES in step S15. In this case, the controller 20 determines that no extraneous matter accumulates on the thermistor 16 and performs a normal or general operation.

As described above, in step S15, the comparing unit 26 of the controller 20 pays attention to the data stored in the operation ratio data storing unit 23*b* in step S3, S5, and S7 and calculates the average value of the data retrieved from the operation ratio data storing unit 23*b*. The comparing unit 26 also calculates the average value of the data retrieved from the normal ratio data storing unit 23*a*. The comparing unit 26 then determines whether the calculated average value of the data retrieved from the operation ratio data storing unit 23*b* is equal to or less than the reference value (i.e., calculated average value of the data retrieved from the normal ratio data storing unit 23*a*). For example, FIG. 5B illustrates an abnormal state in which the heating duty is 100% during all the periods of time "t1", "t2", and "t3". That is, an average of the heating duty during the periods of time "t1", "t2", and "t3" is 100%. In a case in which the reference heating duty is 95%, the average (i.e., 100%) is greater than the reference value (i.e., reference heating duty of 95%), that is, NO in step S15. Then, the process proceeds to step S17.

In step S17, the roller driving unit 27 of the controller 20 drives and rotates the fixing roller 9*a* backwards. Note that when the fixing roller 9*a* is rotated backwards, the fixing roller 9*a* may be rotated a plurality of times or about half a rotation.

Thus, the flow illustrated in FIG. 8 is completed.

Referring now to FIGS. 5A, 5B, 7, and 9 (9A and 9B), a description is given of fixing control operations according to a second embodiment of the present disclosure.

Figure 9A:
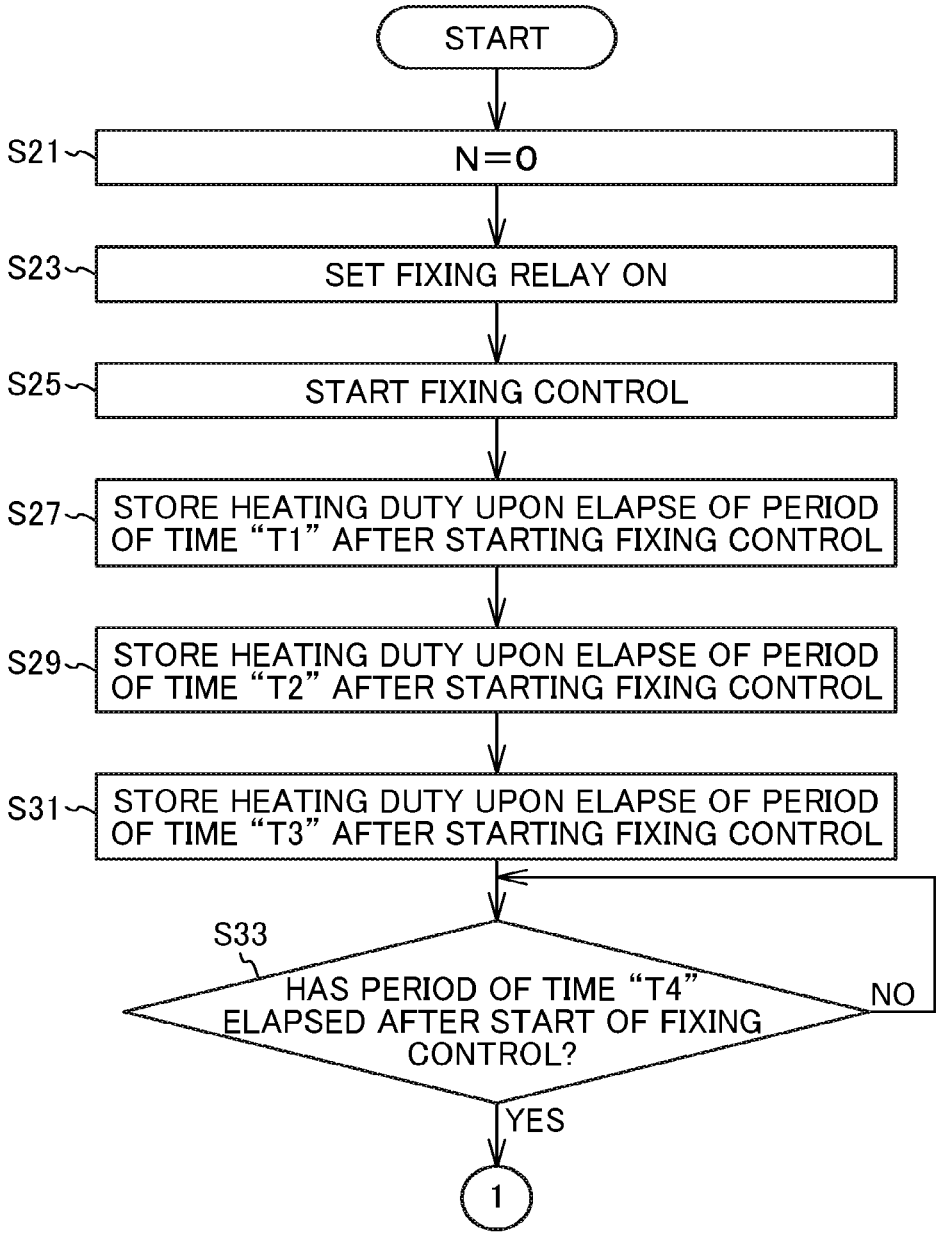
FIG. 9A is a flowchart of operations performed in the image forming apparatus according to a second embodiment of the present disclosure.
Figure 9B:
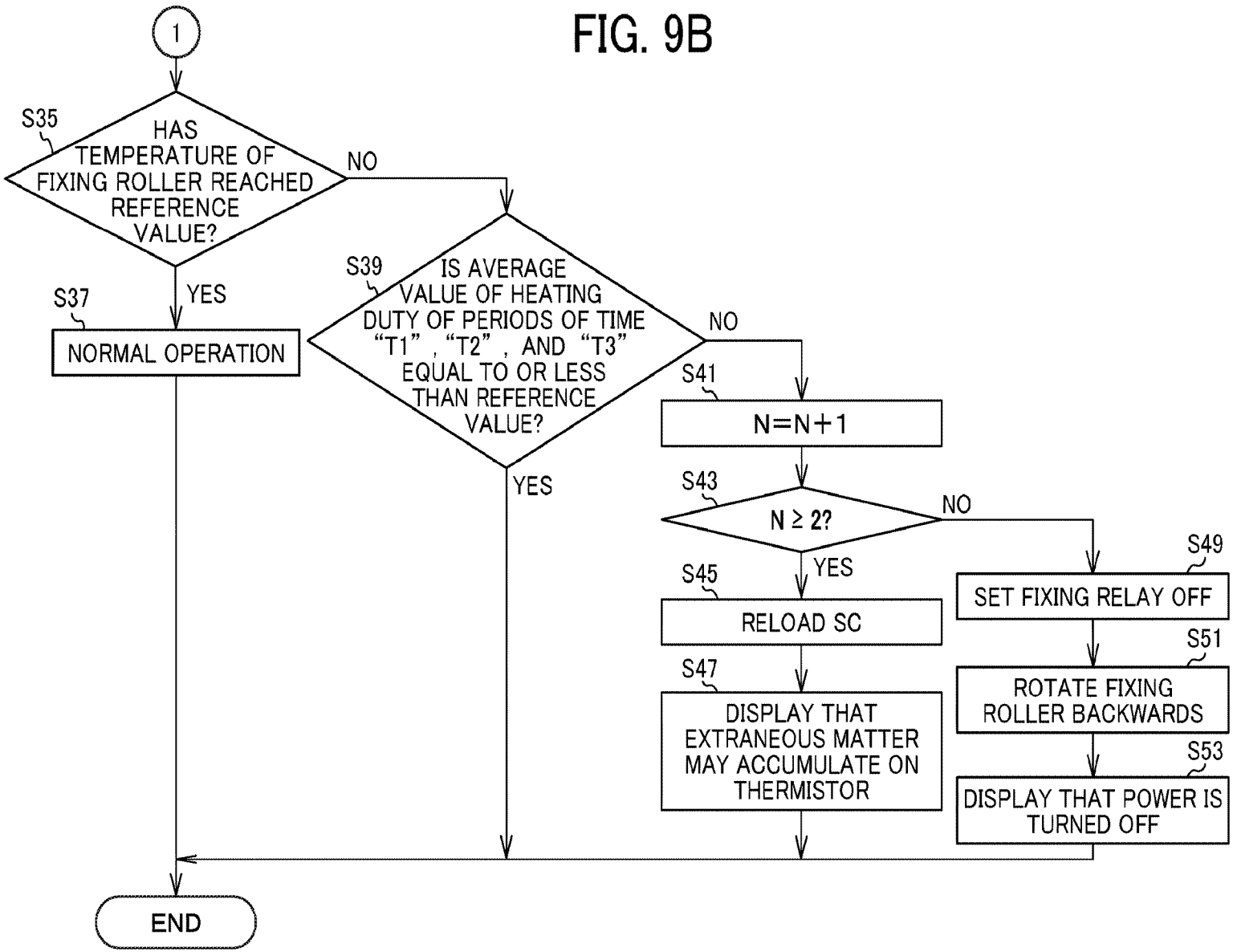
FIG. 9B is a continuation of the flowchart of the operations performed in the image forming apparatus in FIG. 9A.

FIG. 9A is a flowchart of operations performed in the image forming apparatus 1 according to the second embodiment of the present disclosure. FIG. 9B is a continuation of the flowchart of the operations performed in the image forming apparatus 1 in FIG. 9A.

In step S21, the controller 20 initializes a counter in the controller 20. Specifically, "N=0" is input.

Subsequently in step S23, the controller 20 sets a relay (or fixing relay) on. Note that, with the relay, the fixing heater 9*c* of the fixing device 9 is powered on and off. The relay is herein a latch-type relay. Once the relay is turned off, a service person, for example, resets the relay on in response to an SC.

Subsequently in step S25, the heater control unit 22 of the controller 20 supplies power to the fixing heater 9*c* of the fixing device 9 to start fixing control (i.e., point A in FIGS. 5A and 5B).

Subsequently in step S27, the controller 20 stores, in the operation ratio data storing unit 23*b*, the heating duty upon an elapse of the period of time "t1" from a start of a timer (i.e., point B: 5 seconds from the point A in FIGS. 5A and 5B).

Subsequently in step S29, the controller 20 stores, in the operation ratio data storing unit 23*b*, the heating duty upon an elapse of the period of time "t2" (i.e., point C: 10 seconds from the point A in FIGS. 5A and 5B).

Subsequently in step S31, the controller 20 stores, in the operation ratio data storing unit 23*b*, the heating duty upon an elapse of the period of time "t3" (i.e., point D: 15 seconds from the point A in FIGS. 5A and 5B).

Subsequently in step S33, the controller 20 monitors whether the timer has counted the period of time "t4". In other words, the controller 20 determines whether the period of time "t4" has elapsed. When the period of time "t4" has not elapsed (NO in step S33), the process repeats the determination in step S33. By contrast, when the period of time "t4" has elapsed (YES in step S33), the process proceeds to step S35.

In step S35, the temperature detecting unit 21 of the controller 20 detects the temperature of the fixing roller 9*a* of the fixing device 9 with the thermistor 16 and monitors or determines whether the temperature of the heating roller 9*a* has reached a reference value. When the temperature of the heating roller 9*a* has reached the reference value (YES in step S35), the process proceeds to step S37.

In step S37, the controller 20 determines that the fixing device 9 is in a normal state. The roller driving unit 27 drives and rotates the fixing roller 9*a* forwards, as a general operation, thereby continuing the fixing operation.

By contrast, when the temperature detecting unit 21 of the controller 20 determines that the temperature of the heating roller 9*a* has not reached the reference value based on the temperature of the fixing roller 9*a* of the fixing device 9 detected with the thermistor 16 (NO in step S35), the process proceeds to step S39.

In step S39, the comparing unit 26 of the controller 20 pays attention to the data stored in the operation ratio data storing unit 23*b* in step S27, S29, and S31 and calculates an average value of the data retrieved from the operation ratio data storing unit 23*b*. The comparing unit 26 also calculates an average value of the data retrieved from the normal ratio data storing unit 23*a*. The comparing unit 26 then determines whether the calculated average value of the data retrieved from the operation ratio data storing unit 23*b* is equal to or less than a reference value (i.e., calculated average value of the data retrieved from the normal ratio data storing unit 23*a*). For example, as described above, FIG. 5A illustrates the normal state in which the heating duty is: 100% during the period of time "t1", 100% during the period of time "t2", and 80% during the period of time "t3". The average of the heating duty during the periods of time "t1", "t2", and "t3" is about 93%. In a case in which a reference heating duty is 95%, the average (i.e., about 93%) is less than the reference value (i.e., reference heating duty of 95%), that is, YES in step S39. In this case, the controller 20 determines that no extraneous matter accumulates on the thermistor 16 and performs a normal or general operation.

As described above, in step S39, the comparing unit 26 of the controller 20 pays attention to the data stored in the operation ratio data storing unit 23*b* in step S27, S29, and S31 and calculates the average value of the data retrieved from the operation ratio data storing unit 23*b*. The comparing unit 26 also calculates the average value of the data retrieved from the normal ratio data storing unit 23*a*. The comparing unit 26 then determines whether the calculated average value of the data retrieved from the operation ratio data storing unit 23*b* is equal to or less than the reference value (i.e., calculated average value of the data retrieved from the normal ratio data storing unit 23*a*). For example, FIG. 5B illustrates the abnormal state in which the heating duty is 100% during all the periods of time "t1", "t2", and "t3". That is, the average of the heating duty during the periods of time "t1", "t2", and "t3" is 100%. In a case in which the reference heating duty is 95%, the average (i.e., 100%) is greater than the reference value (i.e., reference heating duty of 95%), that is, NO in step S39. Then, the process proceeds to step S41.

In step S41, the controller 20 increments the counter. Specifically, "N=N+1" is input.

Subsequently in step S43, the controller 20 determines whether a value of the counter is equal to or greater than 2 (i.e., N≥2). When the value of the counter is equal to or greater than 2 (YES in step S43), the process proceeds to step S45.

In step S45, the controller 20 reloads an Sc.

Subsequently in step S47, the controller 20 displays on the display 28 that extraneous matter accumulates or may accumulate on the thermistor 16.

As described above, in step S43, the controller 20 determines whether the value of the counter is equal to or greater than 2 (i.e., N≥2). When the controller 20 determines that the value of the counter is less than 2 (NO in step S43), the process proceeds to step S49.

In step S49, the controller 20 turns off the fixing relay, which has been turned on in step S23. Then, the process proceeds to step S51.

Subsequently in step S51, the roller driving unit 27 of the controller 20 drives and rotates the fixing roller 9*a* backwards. Then, the process proceeds to S53.

Subsequently in step S53, the controller 20 displays on the display 28 that the power is turned off.

Thus, the flow illustrated in FIG. 9 (FIGS. 9A and 9B) is completed.

The fixing devices described above have some or all of the following advantages in first to eighth aspects, enumeration of which is not exhaustive or limiting.

Initially, a description is given of the first aspect.

A fixing device (e.g., fixing device 9) includes a heating rotator (e.g., fixing roller 9*a*) and a pressure rotator (pressure roller 9*b*) that presses against the heating rotator to form a fixing nip between the heating rotator and pressure rotator. The heating rotator includes a heater (e.g., fixing heater 9*c*). While a recording medium (e.g., recording medium P) bearing a toner image is conveyed through the fixing nip by the heating rotator and the pressure rotator each rotating or moving in a fixing direction of rotation, the fixing device fixes the toner image onto the recording medium. The fixing device further includes a temperature detector (e.g., thermistor 16), and a controller (e.g., controller 20). The temperature detector detects a temperature of the heating rotator. The controller energizes and deenergizes the heater of the heating rotator to control a fixing temperature of the heating rotator to be a reference value. The controller also controls a direction of rotation of each of the heating rotator and the pressure rotator to drive, with a driver (e.g., roller driving unit 27), each of the heating rotator and the pressure rotator in one of a fixing direction of rotation (e.g., directions of rotation R1 and R2) and a reverse direction of rotation (e.g., directions of rotation R11 and R12) opposite the fixing direction of rotation. In a case in which the fixing temperature is less than the reference value upon an elapse of a given period of time from a start of heating, the controller changes the direction of rotation of each of the heating rotator and the pressure rotator to the reverse direction of rotation.

According to the present aspect, the controller controls the fixing temperature of the heating rotator to be the reference value. In a case in which the fixing temperature is less than the reference value upon the elapse of the given period of time from the start of heating, the controller determines that the temperature detector malfunctions or that extraneous matter may accumulate on the temperature detector. The controller then changes the direction of rotation of each of the heating rotator and the pressure rotator to the reverse direction of rotation.

Accordingly, the reverse rotation of the heating rotator generates a resistance to remove the extraneous matter from the temperature detector, thereby allowing a continuation of an image forming operation.

A description is now given of the second aspect.

The fixing device further includes a memory (e.g., normal ratio data storing unit 23*a*, operation ratio data storing unit 23*b*). The memory stores normal ratio data of a duration for energizing the heating rotator to a duration for deenergizing the heating rotator until the fixing temperature reaches the reference value in a normal state. The memory also stores operation ratio data of the duration for energizing the heating rotator to the duration for deenergizing the heating rotator until the fixing temperature reaches the reference value during operation.

The controller changes a ratio of the duration for energizing the heating rotator to the duration for deenergizing the heating rotator during operation, to control the fixing temperature.

According to the present aspect, the memory stores the normal ratio data of the duration for energizing the heating rotator until the fixing temperature reaches the reference value in the normal state and the operation ratio data of the duration for energizing the heating rotator until the fixing temperature reaches the reference value during operation.

Accordingly, the controller determines, in response to each job, whether heating duty data (i.e., the ratio data of the duration for energizing the heating rotator including the heater) is normal. That is, a malfunction of fixing operation can be immediately found.

A description is now given of the third aspect.

In response to determination that it is time for the fixing temperature to reach the reference value, the controller compares an average of the operation ratio data retrieved from the memory with an average of the normal ratio data retrieved from the memory. In a case in which the average of the operation ratio data retrieved from the memory is equal to or less than the average of the normal ratio data retrieved from the memory, the controller determines that the operation ratio data stored in the memory is normal. By contrast, in a case in which the average of the operation ratio data retrieved from the memory is greater than the average of the normal ratio data retrieved from the memory, the controller determines that the operation ratio data stored in the memory is abnormal.

According to the present aspect, the controller compares an average value of the ratio data during operation (i.e., the average of the operation ratio data retrieved from the memory) with an average value of the ratio data in a normal state (i.e., the average of the normal ratio data retrieved from the memory). In a case in which the average value of the ratio data during operation is equal to or less than the average value of the ratio data in the normal state, the controller determines that the heating duty is normal. By contrast, in a case in which the average value of the ratio data during operation is greater than the average value of the ratio data in the normal state, the controller determines that the heating duty is abnormal.

Accordingly, the controller determines whether the fixing operation is in a normal state by simple calculation.

A description is now given of the fourth aspect.

In response to determination that the average of the operation ratio data retrieved from the memory is greater than the average of the normal ratio data retrieved from the memory based on comparison of the average of the operation ratio data retrieved from the memory with the average of the normal ratio data retrieved from the memory, the controller determines that extraneous matter accumulates on the temperature detector and provides information indicating that the extraneous matter accumulates on the temperature detector.

According to the present aspect, in response to determination that the operation ratio data (i.e., heating duty) stored in the memory is abnormal based on the comparison of the average value of the ratio data during operation with the average value of the ratio data in the normal state, the controller determines that extraneous matter accumulates on the temperature detector and provides information indicating that the extraneous matter accumulates on the temperature detector.

Accordingly, a user, for example, ascertains a current state of an image forming apparatus (e.g., image forming apparatus 1). That is, the maintenance is focused on the fixing device.

A description is now given of the fifth aspect.

In response to detection of a malfunction or an abnormality again after the controller determines that the extraneous matter accumulates on the temperature detector and provides the information indicating that the extraneous matter accumulates on the temperature detector, the controller changes a driving direction, that is, the direction of rotation of each of the heating rotator and the pressure rotator to the reverse direction of rotation. The controller then provides information indicating a halt of an image forming apparatus including the fixing device.

According to the present aspect, in response to detection of a malfunction or an abnormality again after the controller provides the information indicating that the extraneous matter accumulates on the temperature detector, the controller changes the direction of rotation of each of the heating rotator and the pressure rotator to the reverse direction and stops the image forming apparatus.

Accordingly, the extraneous matter is mechanically removed from the temperature detector, thereby allowing a continuation of the image forming operation.

A description is now given of the sixth aspect.

An image forming apparatus (e.g., image forming apparatus 1) includes the fixing device (e.g., fixing device 9) according to one of the first to fifth aspects.

According to the present aspect, the image forming apparatus is configured to constantly monitor the state of the fixing device. Accordingly, the image forming apparatus has enhanced reliability and maintenance accuracy.

A description is now given of the seventh aspect.

A fixing device (e.g., fixing device 9) includes a heating rotator (e.g., fixing roller 9*a*), a pressure rotator (e.g., pressure roller 9*b*), a temperature detector (e.g., thermistor 16), and a controller (e.g., controller 20). The heating rotator includes a heater (e.g., fixing heater 9*c*). The controller includes a driver (e.g., roller driving unit 27). The temperature detector detects a temperature of the heating rotator. The fixing device executes a fixing method for fixing a toner image on a recording medium (e.g., recording medium P) while the recording medium bearing the toner image is conveyed between the heating rotator and the pressure rotator each rotating or moving in a fixing direction of rotation (e.g., directions of rotation R1 and R2). The fixing method includes: energizing and deenergizing the heater of the heating rotator to control a fixing temperature of the heating rotator to be a reference value, controlling a direction of rotation of each of the heating rotator and the pressure rotator to drive, with the driver, each of the heating rotator and the pressure rotator in one of the fixing direction of rotation and a reverse direction of rotation (e.g., directions of rotation R11 and R12) opposite the fixing direction of rotation, and changing the direction of rotation of each of the heating rotator and the pressure rotator to the reverse direction of rotation in a case in which the fixing temperature is less than the reference value upon an elapse of a given period of time from a start of heating (e.g., step S17).

According to the present aspect, the controller controls the fixing temperature of the heating rotator to be the reference value. In a case in which the fixing temperature is less than the reference value upon the elapse of the given period of time from the start of heating, the controller determines that the temperature detector malfunctions or that extraneous matter may accumulate on the temperature detector. The controller then changes the direction of rotation of each of the heating rotator and the pressure rotator to the reverse direction of rotation.

Accordingly, the reverse rotation of the heating rotator generates a resistance to remove the extraneous matter from the temperature detector, thereby allowing a continuation of an image forming operation.

A description is now given of the eighth aspect.

A non-transitory, computer-readable storage medium stores computer-readable program code that causes a computer to perform the fixing method according to the seventh aspect.

According to the present aspect, the computer performs the fixing method described above. Accordingly, the reverse rotation of the heating rotator generates a resistance to remove the extraneous matter from the temperature detector, thereby allowing a continuation of an image forming operation.

According to the embodiments described above, even in a case in which extraneous matter accumulates between a temperature detector and a roller in a fixing device, an image forming operation is continued by providing information indicating accumulation of the extraneous matter and removing the extraneous matter.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

For example, the image forming apparatus incorporating the fixing device according to an embodiment described above is not limited to a monochrome image forming apparatus as illustrated in FIG. 1. Alternatively, the image forming apparatus may be a color image forming apparatus that forms monochrome and color toner images on recording media. In addition, the image forming apparatus to which the embodiments of the present disclosure are applied includes but is not limited to a printer, a copier, a facsimile machine, or a multifunction peripheral having at least two capabilities of these devices.

Any one of the above-described operations may be performed in various other ways, for example, in an order different from that described above.

Any of the above-described devices or units can be implemented as a hardware apparatus, such as a special-purpose circuit or device, or as a hardware/software combination, such as a processor executing a software program.

Further, each of the functions of the described embodiments may be implemented by one or more processing circuits or circuitry. Processing circuitry includes a programmed processor, as a processor includes circuitry. A processing circuit also includes devices such as an application-specific integrated circuit (ASIC), digital signal processor (DSP), field programmable gate array (FPGA) and conventional circuit components arranged to perform the recited functions.

Further, as described above, any one of the above-described and other methods of the present disclosure may be embodied in the form of a computer program stored on any kind of storage medium. Examples of storage media include, but are not limited to, floppy disks, hard disks, optical discs, magneto-optical discs, magnetic tapes, nonvolatile memory cards, read only memories (ROMs), etc.

Alternatively, any one of the above-described and other methods of the present disclosure may be implemented by the ASIC, prepared by interconnecting an appropriate network of conventional component circuits or by a combination thereof with one or more conventional general-purpose microprocessors and/or signal processors programmed accordingly.

What is claimed is:

1. A fixing device, comprising:

a heating rotator including a heater;

a pressure rotator configured to press against the heating rotator to form a fixing nip through which a recording medium bearing a toner image is conveyed by the heating rotator and the pressure rotator each moving in a fixing direction of rotation;

a temperature detector configured to detect a temperature of the heating rotator; and circuitry configured to:

energize and deenergize the heater of the heating rotator to control the temperature of the heating rotator to be a reference value;

control a direction of rotation of each of the heating rotator and the pressure rotator to drive each of the heating rotator and the pressure rotator in one of the fixing direction of rotation and a reverse direction of rotation opposite the fixing direction of rotation;

initiate supply of power to the heater and start a timer to measure elapsed time;

determine whether an abnormal condition occurs in which both the detected temperature of the heating rotator is less than the reference value and the elapsed time exceeds a predetermined time; and in response to determining that the abnormal condition has occurred, change the direction of rotation of each of the heating rotator and the pressure rotator to the reverse direction of rotation.

2. The fixing device according to claim 1, further comprising a memory to:

store normal ratio data of a duration for energizing the heating rotator to a duration for deenergizing the heating rotator until the temperature of the heating rotator reaches the reference value in a normal state; and store operation ratio data of the duration for energizing the heating rotator to the duration for deenergizing the heating rotator until the temperature of the heating rotator reaches the reference value during operation, wherein the circuitry is further configured to change a ratio of the duration for energizing the heating rotator to the duration for deenergizing the heating rotator during operation, to control the temperature of the heating rotator.

3. The fixing device according to claim 2, wherein the circuitry further is configured to compare an average of the operation ratio data retrieved from the memory with an average of the normal ratio data retrieved from the memory in response to a determination that it is time for the temperature of the heating rotator to reach the reference value, wherein the circuitry is further configured to determine that the operation ratio data stored in the memory is normal when the average of the operation ratio data retrieved from the memory is equal to or less than the average of the normal ratio data retrieved from the memory, and wherein the circuitry is further configured to determine that the operation ratio data stored in the memory is abnormal when the average of the operation ratio data retrieved from the memory is greater than the average of the normal ratio data retrieved from the memory.

4. The fixing device according to claim 2, wherein the circuitry is further configured to determine that extraneous matter accumulates on the temperature detector and provide information indicating that the extraneous matter accumulates on the temperature detector, in response to a determination that an average of the operation ratio data retrieved from the memory is greater than an average of the normal ratio data retrieved from the memory, based on comparison of the average of the operation ratio data retrieved from the memory with the average of the normal ratio data retrieved from the memory.

5. The fixing device according to claim 4, wherein the circuitry is further configured to change the direction of rotation of each of the heating rotator and the pressure rotator to the reverse direction of rotation and provide information indicating a halt of an image forming apparatus that includes the fixing device, in response to detection of an abnormality again after the circuitry determines that the extraneous matter accumulates on the temperature detector and provides the information indicating that the extraneous matter accumulates on the temperature detector.

6. An image forming apparatus comprising the fixing device according to claim 1.

7. The fixing device of claim 1, wherein the circuitry is further configured to determine whether the detected temperature of the heating rotator is less than the reference value only after determining that the elapsed time exceeds the predetermined time.

8. The fixing device of claim 1, wherein the circuitry is further configured to change the direction of the rotation only when determining that the detected temperature of the heating rotator is less than the reference value.

9. A fixing method, comprising:

energizing and deenergizing a heater of a heating rotator to control a fixing temperature of the heating rotator to be a reference value;

controlling a direction of rotation of each of the heating rotator and a pressure rotator to drive each of the heating rotator and the pressure rotator in one of a fixing direction of rotation and a reverse direction of rotation opposite the fixing direction of rotation;

initiating supply of power to the heater and start a timer to measure elapsed time;

determining whether an abnormal condition occurs in which both the detected temperature of the heating rotator is less than the reference value and the elapsed time exceeds a predetermined time; and in response to determining that the abnormal condition has occurred, changing the direction of rotation of each of the heating rotator and the pressure rotator to the reverse direction of rotation.

10. A non-transitory, computer-readable storage medium stores computer-readable program code that causes a computer to perform a fixing method, the fixing method comprising:

energizing and deenergizing a heater of a heating rotator to control a fixing temperature of the heating rotator to be a reference value;

controlling a direction of rotation of each of the heating rotator and a pressure rotator to drive each of the heating rotator and the pressure rotator in one of a fixing direction of rotation and a reverse direction of rotation opposite the fixing direction of rotation;

initiating supply of power to the heater and start a timer to measure elapsed time;

determining whether an abnormal condition occurs in which both the detected temperature of the heating rotator is less than the reference value and the elapsed time exceeds a predetermined time; and in response to determining that the abnormal condition has occurred, changing the direction of rotation of each of the heating rotator and the pressure rotator to the reverse direction of rotation.

* * * * *